US005084109A

United States Patent [19]

Sikka

[11] Patent Number: 5,084,109

[45] Date of Patent: Jan. 28, 1992

[54] ORDERED IRON ALUMINIDE ALLOYS HAVING AN IMPROVED ROOM-TEMPERATURE DUCTILITY AND METHOD THEREOF

[75] Inventor: Vinod K. Sikka, Clinton, Tenn.

[73] Assignee: Martin Marietta Energy Systems, Inc., Oak Ridge, Tenn.

[21] Appl. No.: 548,472

[22] Filed: Jul. 2, 1990

[51] Int. Cl.[5] ..... C21D 8/00

[52] U.S. Cl. ..... 148/12 R; 148/12.4; 148/320

[58] Field of Search ..... 148/12 R, 12.4, 320; 420/77

[56] References Cited

U.S. PATENT DOCUMENTS 2,768,915 10/1956 Nachman et al. ..... 148/2

OTHER PUBLICATIONS

C. T. Liu et al., "An Environmental Effect as the Major Cause for Room-Temperature Embrittlement in FeAl", Scripta Metallurgica, vol. 23, pp. 875-880, 1989.

J. F. Nachman et al., "16 Percent Aluminum-Iron Alloy Cold Rolled in the Order-Disorder Temperature Range", *Journal of Applied Physics*, vol. 25, pp. 307-313, Mar. 1954.

W. Justusson et al., "The Mechanical Properties of Iron-Aluminide Alloys", Transactions of the ASM, vol. 49, pp. 905-923, 1956.

V. K. Sikka et al., "Fabrication and Mechanical Properties of $Fe_3Al$-Based Iron Aluminides", Oak Ridge National Laboratory Report TM-11465 (Mar. 1990).

C. G. McKamey et al., "Effect of Chromium on Room Temperature Ductility and Fracture Mode in $Fe_3Al$", Scripta Metallurgica, vol. 22, pp. 1679-1681 (1988).

M. G. Mendiratta et al., "Tensile Flow and Fracture Behavior of $DO_3$ Fe-25 At. Pct. Al and Fe-31 At. Pct. Al Alloys", Metallurgical Transactions A, vol. 18A, pp. 283-291 (Feb. 1987).

F. X. Kayser, "Iron-Aluminum Alloy Systems", WADC Technical Report 57-298, Part 1, May 1957.

*Primary Examiner*—Deborah Yee

*Attorney, Agent, or Firm*—J. Donald Griffin; Ivan L. Ericson

[57] ABSTRACT

A process is disclosed for improving the room temperature ductility and strength of iron aluminide intermetallic alloys. The process involves thermomechanically working an iron aluminide alloy by means which produce an elongated grain structure. The worked alloy is then heated at a temperature in the range of about 650° C. to about 800° C. to produce a B2-type crystal structure. The alloy is rapidly cooled in a moisture free atmosphere to retain the B2-type crystal structure at room temperature, thus providing an alloy having improved room temperature ductility and strength.

11 Claims, 10 Drawing Sheets

ORDERED IRON ALUMINIDE ALLOYS HAVING AN IMPROVED ROOM-TEMPERATURE DUCTILITY AND METHOD THEREOF

The U.S. Government has rights in this invention pursuant to Contract No. DE-AC05-840R21400 awarded by U.S. Department of Energy contract with Martin Marietta Energy Systems, Inc. This research was funded through the DOE Advanced Research and Technical Development Program.

FIELD OF THE INVENTION

The present invention relates to the development of iron and aluminum intermetallic alloys and more particularly to a new method for improving the room temperature ductility and strength thereof.

BACKGROUND OF THE INVENTION

Iron aluminides, based on or near the $Fe_3Al$ composition, are ordered intermetallic alloys that offer good oxidation resistance, excellent sulfidation resistance, and lower material cost than many stainless steels. Further, these materials conserve strategic elements such as chromium. They have a lower density than stainless steels and, therefore, offer a better strength-to-weight ratio. However, limited ductility at ambient temperature and a sharp drop in strength above 600° C. have been major deterrents to the acceptance of the iron aluminide intermetallic alloys for use in structural applications.

The ductilization of iron aluminides has been the subject of research for more than 50 years. Typically, the maximum room temperature ductility obtained has been in the range of about 1 to 5%. In a commonly assigned patent application Ser. No. 319,771, filed Mar. 7, 1989, now U.S. Pat. No. 4,961,903 in the names of Claudette G. McKamey and Chain T. Liu, a composition based on $Fe_3Al$ plus selected additions of chromium, molybdenum, niobium, zirconium, vanadium, boron, carbon, and yttrium is disclosed having a room temperature ductility up to about 10%. This application and the references cited therein are hereby incorporated by reference.

In a journal article entitled "An Environmental Effect as the Major Cause for Room Temperature Embrittlement in FeAl," by C. T. Liu, E. H. Lee and C. G. McKamey, *Scripta Metallurgica*, Vol. 23, pp. 875-880 (1989), a mechanism is proposed to explain the low ductility and brittle fracture problem in $Fe_3Al$ and FeAl. The mechanism suggested by Liu et al involves the dissociation of water molecules in the environment by aluminum atoms on the surface of the alloy resulting in the formation of atomic hydrogen. The atomic hydrogen drives into the metal along cleavage plains during stressing, causing embrittlement. No solution to the problem is suggested.

In another journal article entitled "16 Percent Aluminum-Iron Alloy Cold Rolled in the Order-Disorder Temperature Range," by J. F. Nachman and W. J. Buehler, *Journal of Applied Physics*, Vol. 25, No. 3, pp. 307-313 (March 1954), discussion is provided regarding ductilization of iron aluminides. The author advocates reordering of the alloy by very slow cooling or by heating for prolonged periods in the temperature range of 450° C. to 560° C.

SUMMARY OF THE INVENTION

Among the objects of the present invention is the provision of a method whereby the room temperature ductility of the typically $DO_3$-type, ordered crystal structure of $Fe_3Al$ based alloys is improved. More specifically, it is an objective of this invention to provide thermomechanical and processing treatments for these alloys which substantially improves the room temperature ductility and strength thereof. Yet another object of the invention is to provide a product structure which exhibits substantially improved room temperature ductility and strength over the prior art $DO_3$-type, ordered structure in $Fe_3Al$ based alloys.

These and other objects of the present invention are provided by a new and improved method wherein the iron aluminide based alloys are thermomechanically worked by a means which produces an elongated grain structure. The grains making up the elongated grain structure are oriented generally in the primary working direction. The worked alloy is then heated at a temperature and for a time sufficient to produce a B2-type ordered crystal structure followed by rapid cooling in a moisture-free medium to produce alloys having improved room temperature ductility and strength. The B2 crystal structure is characterized by a body centered cubic (bcc) structure which may exist at temperatures between about 550° C. and 1100° C. By the above treatment, more than 95% of the elongated grains have an aspect ratio (i.e., ratio of grain length to grain thickness) greater than about 20.

The present new and improved method for rendering iron aluminide intermetallic based alloys both ductile and strong at room temperature is applicable to $Fe_3Al$ base alloys normally exhibiting the $DO_3$-type ordered crystal structure at room temperature. These alloys consist essentially of about 25 to 31 at. % aluminum, minor alloying constituents including Cr, Zr, Nb, Mo, B.C. Y, and mixtures thereof, and the balance iron. The iron aluminide alloy is rendered both ductile and strong at room temperature by first thermomechanically working the alloy to produce an elongated grain structure, the elongated grains making up said elongated grain structure being oriented generally in the primary working direction. About 95% or more of the elongated grains have an aspect ratio grater than about 20. The thus worked alloy is heated at a temperature in the range of 650° C. to 800° C. for a period of time in the range of 15 minutes to 2 hours to produce a B2-type, ordered crystal structure. Subsequently, the treated alloy is quenched in oil to retain the B2-type crystal structure at room temperature to provide alloys having improved room temperature ductility and strength.

The invention further comprises a product prepared by the above described process. The product is an iron aluminide intermetallic alloy prepared by a process comprising thermomechanically working an alloy consisting essentially of 25 to 31 at. % aluminum, minor alloying constituents selected from a class consisting of Cr, Zr, Nb, Mo, B, C, and mixtures thereof, and the balance iron, by means which produce an elongated grain structure, the elongated grains making up said elongated grain structure being oriented generally in the primary working direction. The worked alloy product is heated at a temperature and for a period of time sufficient to produce a B2-type, ordered crystal structure. The heated alloy product is rapidly cooled by quenching in a moisture-free medium, retaining the B2-type, ordered crystal structure to provide an alloy product having improved room temperature ductility and strength.

DETAILED DESCRIPTION OF THE INVENTION

Figure 1:
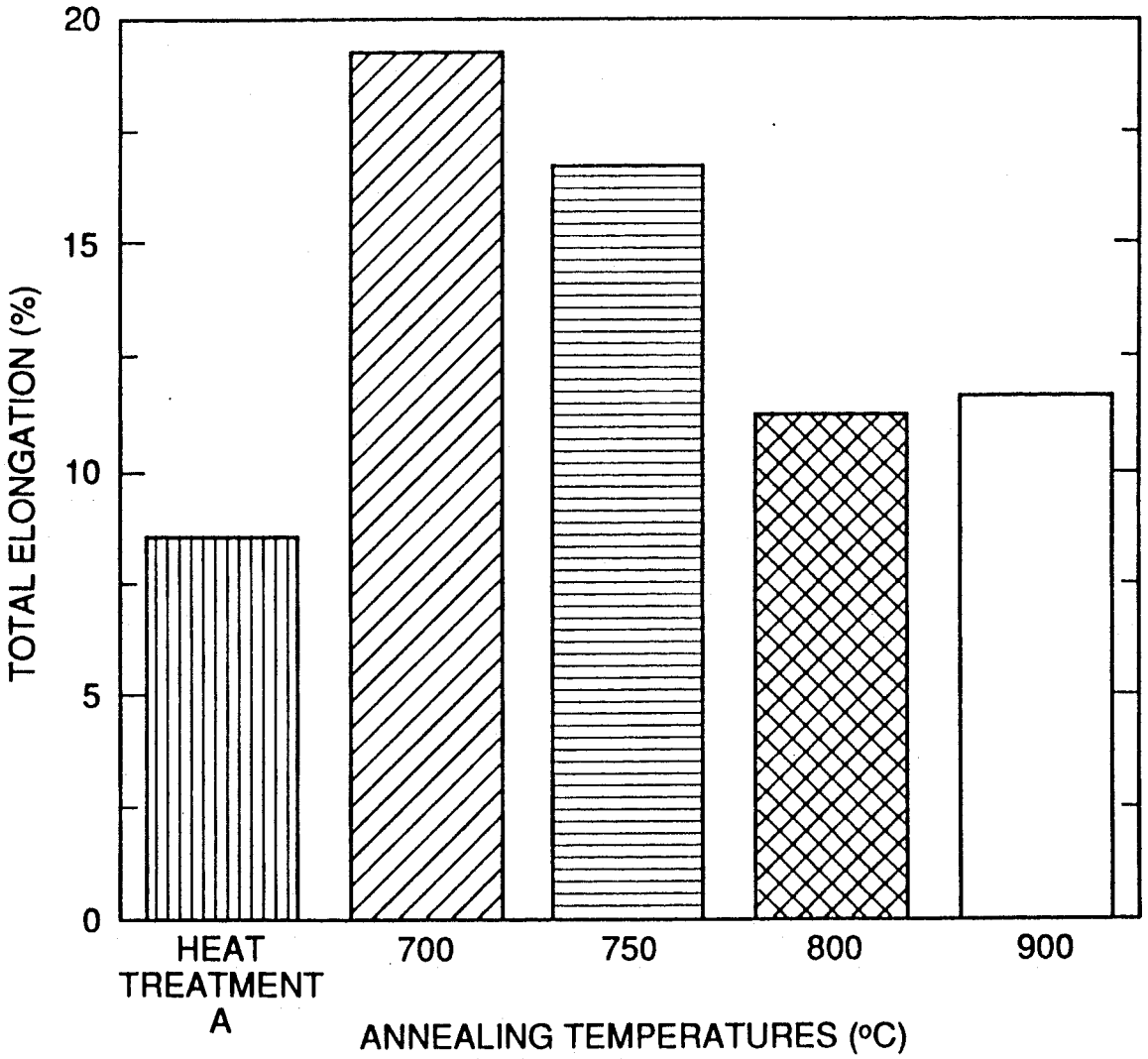
FIG. 1 is a bar graph showing the effect of annealing temperature on the room temperature ductility of an iron aluminide alloy in accordance with this invention.

The iron aluminide intermetallic alloy, $Fe_3Al$, exists in three different crystal structures as a function of temperature. Above 1100° C., the two elements Fe and Al form a solid solution and have a simple bcc (body centered cubic) structure. Two ordered phases exist at lower temperatures. Above 550° C., the structure is known as B2 and below that temperature it is known as $DO_3$. The relative location of Al atoms with respect to Fe atoms is slightly shifted in going from the $DO_3$ to the B2 structure. The B2 structure retained by quenching from temperatures above 550° C. seem to have a direct impact on room temperature elongation values. Too high an annealing temperature prior to quenching may produce larger amounts of recrystallization of the elongated structure in the alloy, thereby resulting in lower ductility. If the annealing temperature is too low, the structure will not be stress relieved, and poor ductility will result.

By applicant's process, highly elongated grains are produced in a thermomechanical procedure (TMP) which minimizes the number of transverse grain boundaries. A stress relieved, elongated grain structure exhibits good room temperature ductility. A stress relieved equiaxed grain structure is relatively brittle at room temperature. Applicant has found that an anneal at a temperature below that at which recrystallization occurs, but above that at which the $DO_3$ structure converts to B2 followed by quenching in a moisturefree medium will produce a ductile iron aluminide alloy at room temperature. An annealing temperature in the range of 650° C. to about 800° C. has been found effective. The preferred annealing temperature is in the range of 700° C. to about 750° C.

The present invention is applicable to iron aluminide alloys based on the $Fe_3Al$ base composition containing aluminum in the 25 to 31 at. % range. While the present invention will provide an improvement in the room temperature ductility and strength of the binary alloy, much better results are obtained when additional constituents are present. For example, the presence of Cr improves the ductility of the binary alloy; therefore, the composition $Fe_3Al$ plus a few atomic percent Cr is an excellent composition for utilization of the present new and improved process. Molybdenum may also be added for improving pitting resistance in aqueous solutions. Niobium and carbon are used to form NbC precipitates for high temperature strength. Zirconium and boron are used to form $ZrB_2$ precipitates for grain refinement. The addition of Nb, Zr, B, and C also increase the temperature at which the room temperature $Fe_3Al$ alloy having the B2-type, ordered crystal structure is stable. In particular, the presence of Cr in the range 2 at. % up to about 10 at. % in $Fe_3Al$ provides an alloy which is substantially improved by the present invention. The addition of Zr or Nb along with the Cr also provides an especially useful alloy. Trace additions of Y, B, V, C and mixtures thereof are also effective in improving room temperature ductility and strength when alloyed with $Fe_3Al$ and treated in accordance with this invention.

Alloys based on the $Fe_3Al$ base composition and additives may be prepared by conventional arc melting, air induction melting, vacuum induction melting and electroslag remelting. Further, the alloys may be fabricated from metal powders of suitable composition. Regardless of the manner in which the $Fe_3Al$ based alloy is prepared, the alloy is given a thermomechanical working by means which produce an elongated grain structure in the alloy. The elongated grains are produced by forging, drawing, rolling, extrusion, etc., of the alloy. Preferably, the grains making up the alloy are oriented generally in the direction of working. The elongated grain structure is then heated to a temperature in the range of 650° C. to 800° C. for a period of time in the range of 15 minutes to 2 hours to produce a B2-type, ordered crystal structure. The heated alloy is then cooled rapidly in a moisture-free medium to stabilize and retain the B2 crystal structure. Preferably, the heated alloy is quenched in oil.

Applicant's new and improved method yields a product retaining a ductile B2-type crystal structure at room temperature which is also novel. The structure is characterized by elongated columnar type grains oriented parallel to the direction of work. Because of the elongated grain structure, there is a reduced number of grain boundaries in a direction transverse to the working direction. Therefore, there is a substantial reduction in grain boundary pathways through which embrittling agents such as atomic hydrogen may diffuse.

Four iron-aluminide compositions were prepared by air-induction melting of the compositions shown in Table 1. The alloys were cast into a 3 in. dia. (15 lb) round ingot in a graphite mold. The ingots were stress relieved by heating to 1000° C. for 3 hours followed by furnace cooling. The ingots were extruded from 3 in.

dia. to ¾ in. dia. at 1000° C. The extruded bars were hot forged at 1000° C., hot rolled at 850° C., and warm rolled at 650° C. to form sheets of 0.030 in. thickness. The sheets were stress relieved by holding at 700° C. for 1 hour followed by either oil quenching or air cooling. Tensile specimens were punched from the sheets at room temperature and then heated in air at various temperatures for one hour followed by oil quenching. The annealed and oil quenched specimens were wiped clean and tensile tested at room temperature. Specimens from one heat were tested over a range of temperatures from room temperature up to 800° C. Most room temperature tensile tests were conducted at a strain rate of 0.2 in./in./min. Some tests were also conducted at strain rates less than, and greater than 0.2 in./in./min.

TABLE I

Chemical Analysis of Iron-Aluminide Heats

| Element | FAL | FALM | FAS28 (A) & (B) | FA129 |
|---|---|---|---|---|
| | Weight Percent | | | |
| Al | 15.88 | 15.88 | 15.93 | 15.85 |
| Cr | 5.46 | 5.46 | 2.19 | 5.45 |
| Zr | 0.19 | — | — | — |
| B | 0.01 | — | 0.011 | — |
| Nb | — | 0.20 | — | 0.97 |
| C | — | 0.04 | — | 0.05 |
| Fe | Bal. | Bal. | Bal. | Bal. |

Figure 2:
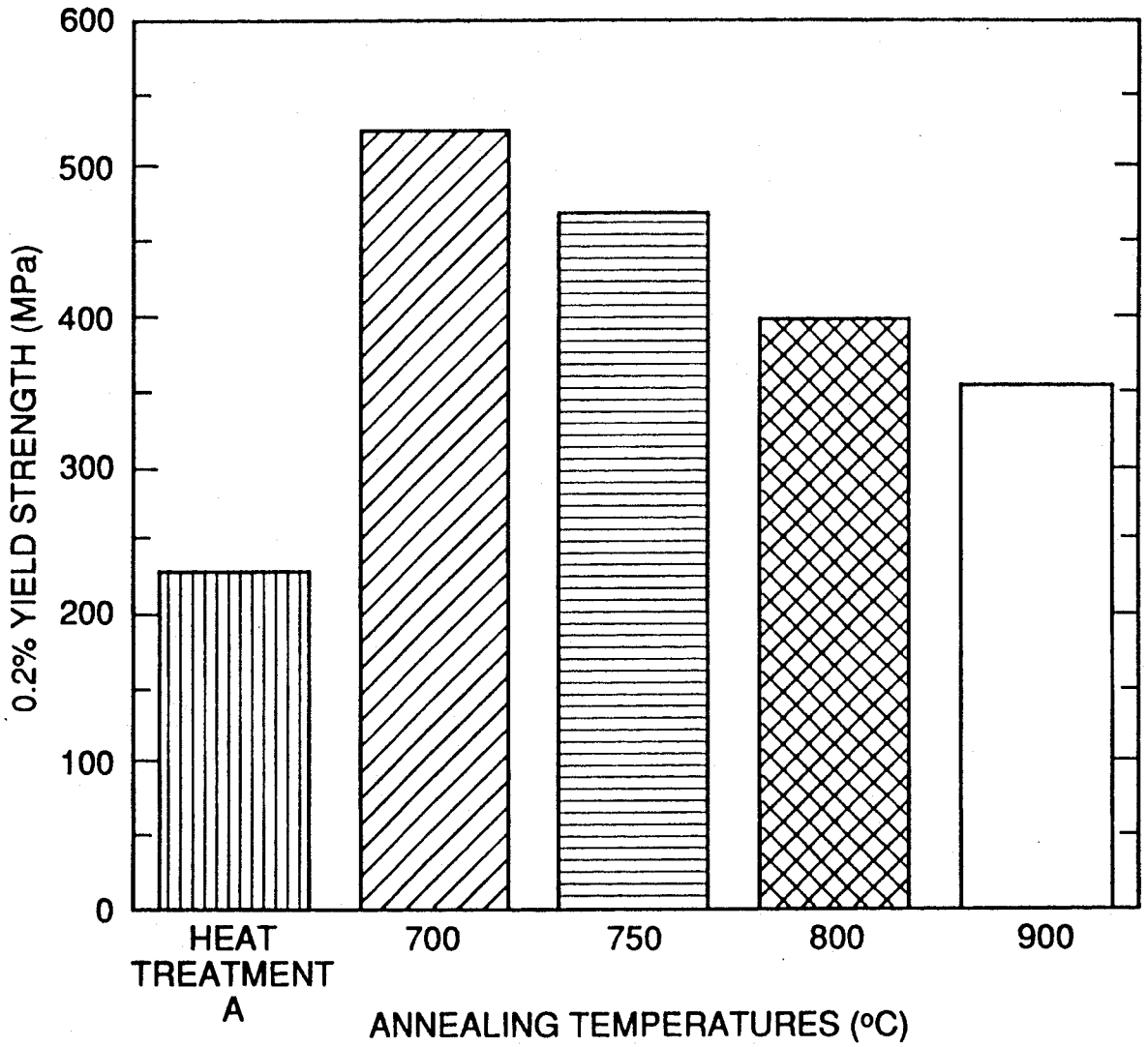
FIG. 2 is a bar graph showing the effect of annealing temperature on room temperature yield strength of an iron aluminide alloy in accordance with this invention.
Figure 3:
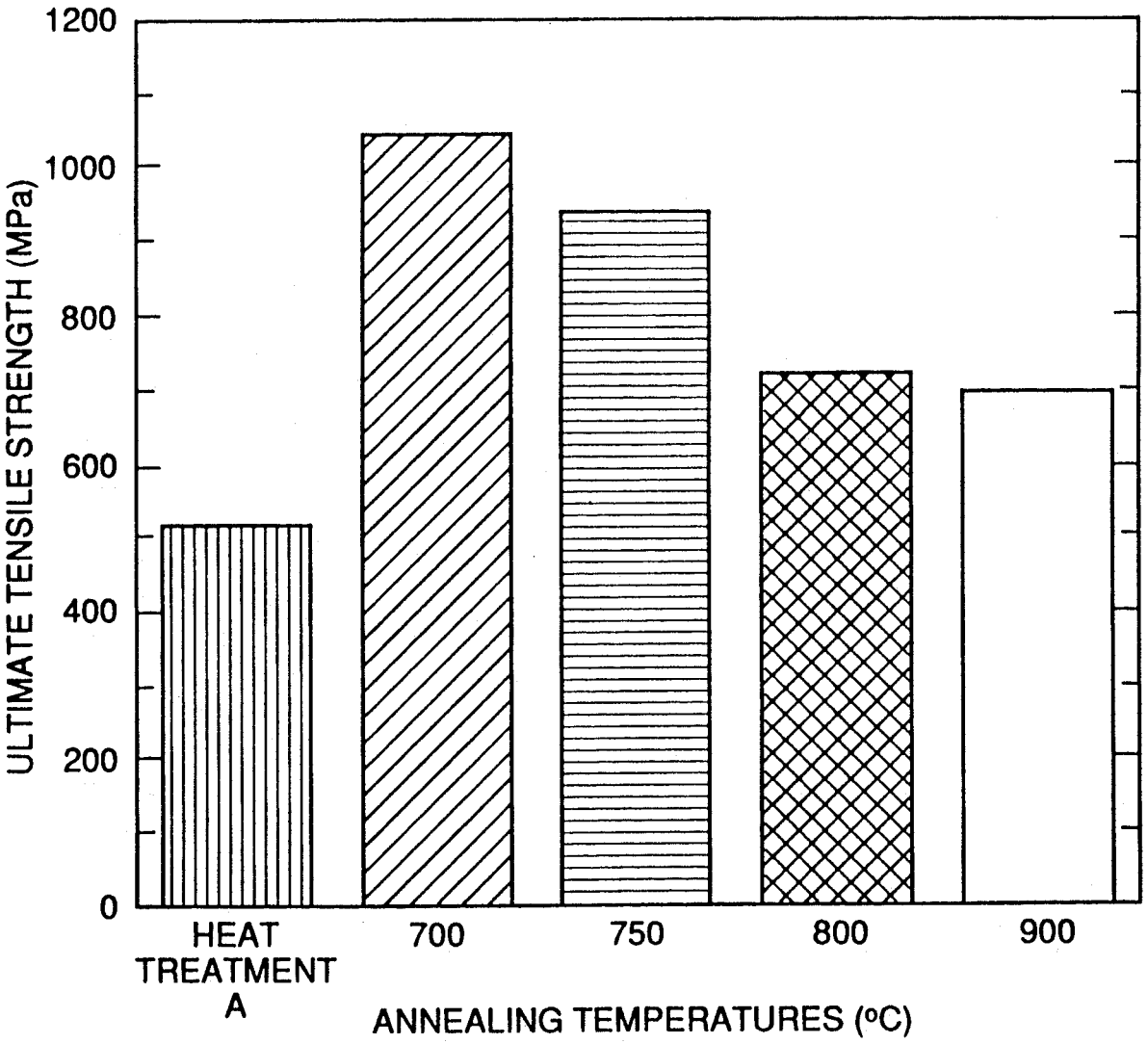
FIG. 3 is a bar graph showing the effect of annealing temperatures on room temperature ultimate tensile strength of an iron aluminide alloy in accordance with this invention.

FIG. 1 shows the effect of annealing temperature and oil quenching treatment on one of the iron aluminide alloys identified as FAL in Table 1. It can be seen that all annealing treatments improve the room temperature (RT) ductility of the as-punched specimens. The bar identified as "heat treatment A" represents specimens treated according to the prior art, i.e., 1 hour at 850° C. plus 5–7 days at 500° C. (air) and air cooled. The 700° C. annealing treatment and oil quench, in accordance with the present invention, gave a RT ductility value of almost 20%. (Ductility values are based on tensile elongation obtained at a specified temperature.) The 750° C. treatment gave a ductility of more than 15% while annealing treatments at temperatures 800° C. and greater gave tensile ductility values slightly over 10%. The yield and tensile strength values for this same alloy are shown in FIGS. 2 and 3. Annealing at a temperature in the range of 700° to 800° C. followed by oil quenching results in a significant improvement in ductility (FIG. 1). Both yield and ultimate tensile strength values also increased with observed increase in ductility.

Figure 4:
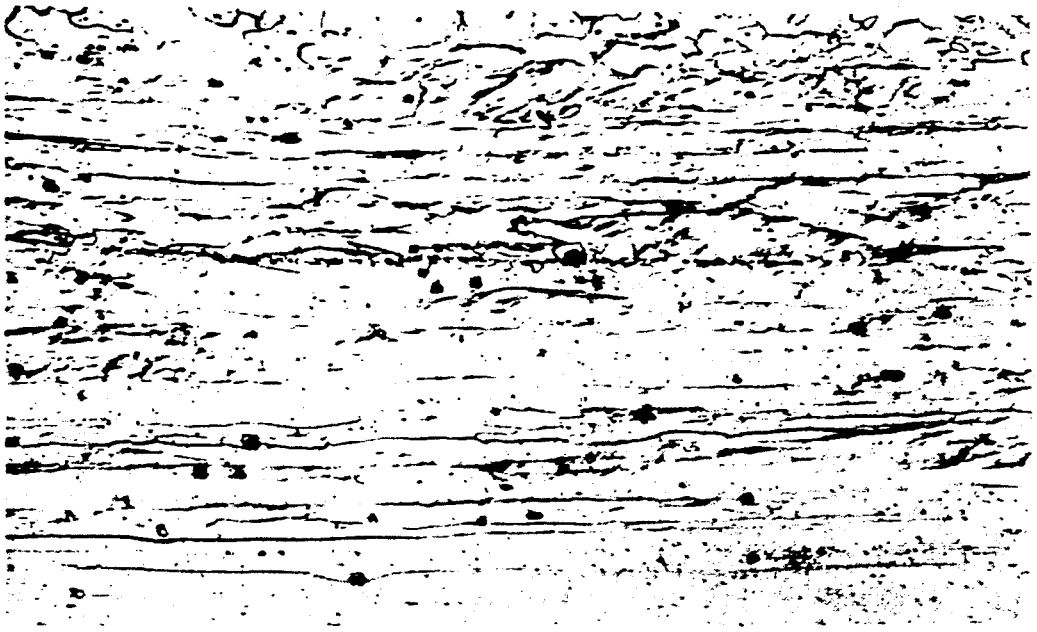
FIGS. 4*a*, 4*b*, 4*c* and 4*d* show the microstructure of iron aluminide alloys after a heat treatment at 700° C., 750° C., 800° C., and 900° C., respectively.
Figure 4B:
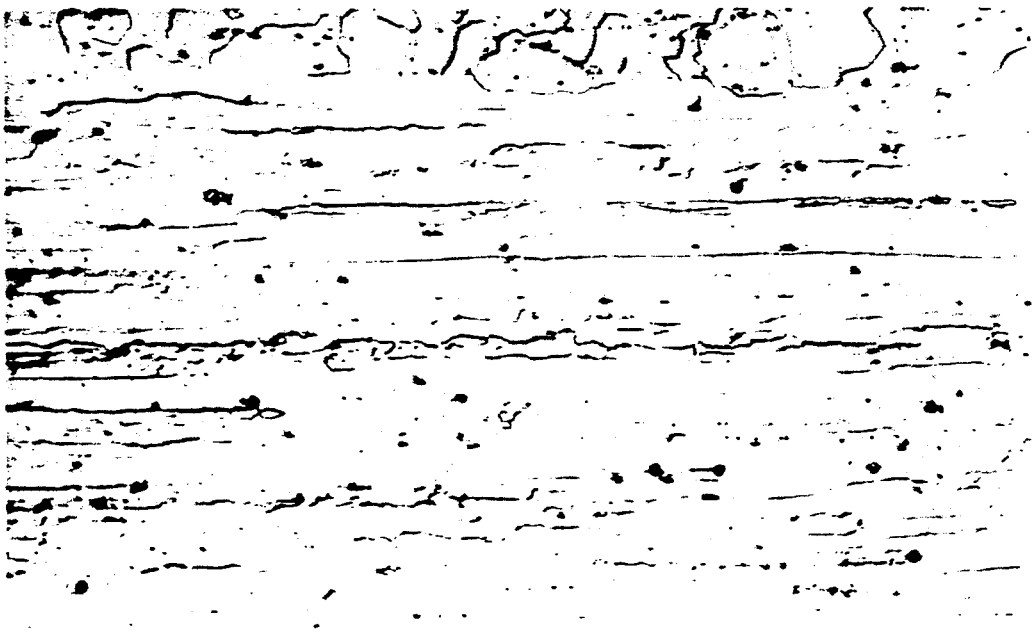
Figure 4C:
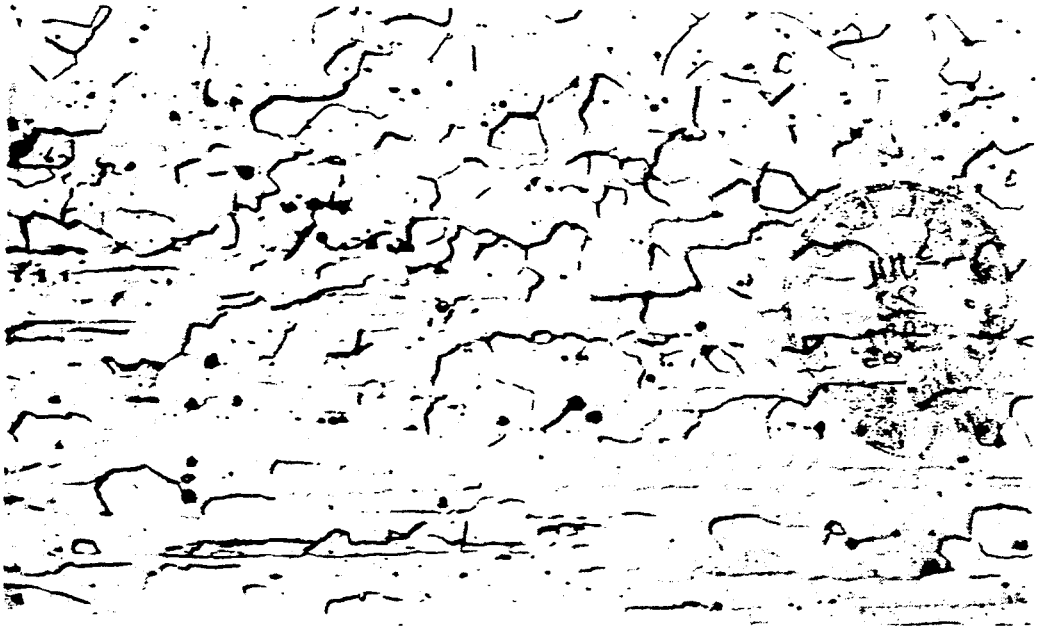
Figure 4D:
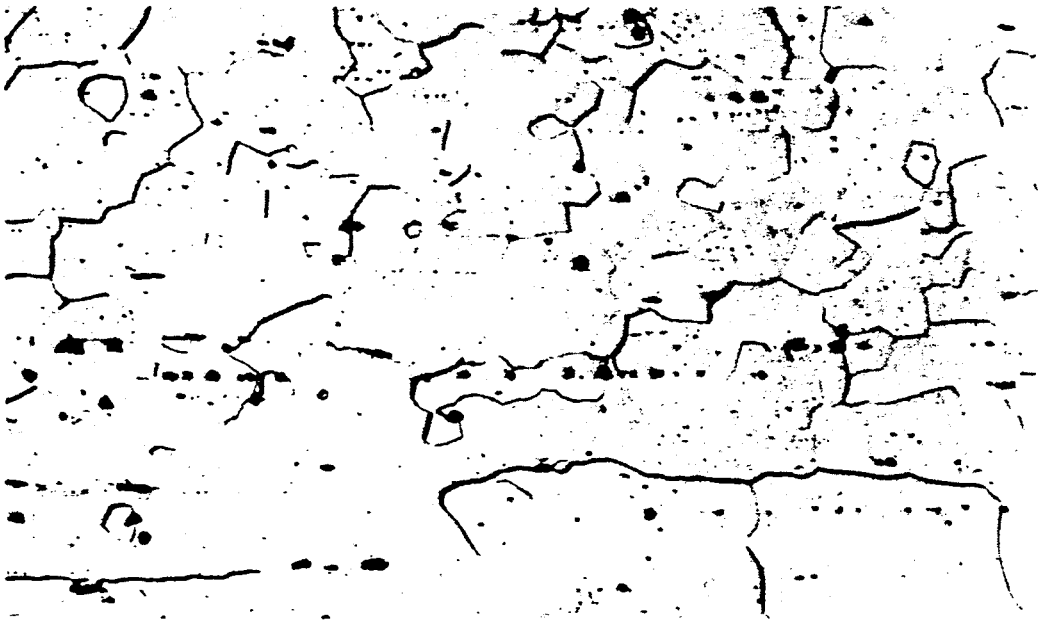

The desired microstructure which is obtained by the subject annealing treatment followed by oil quenching is shown in FIGS. 4*a* and *b*. The 700° C. annealing treatment, produced the highest ductility and produced an excellent combination of yield and ultimate tensile strength. Note the partially recrystallized grain structure obtained at 700° C. and 750° C. (FIGS. 4*a* and 4*b*) which takes on the appearance of a columnar grain structure. The grain structure obtained at 800° C. and 900° C. (FIGS. 4*c* and 4*d*) is a fully recrystallized equiaxed structure (which is normally desirable in other metals and alloys) and does not exhibit the good ductility exhibited by specimens exhibiting the unrecrystallized or only partially recrystallized grain structure.

Figure 5:
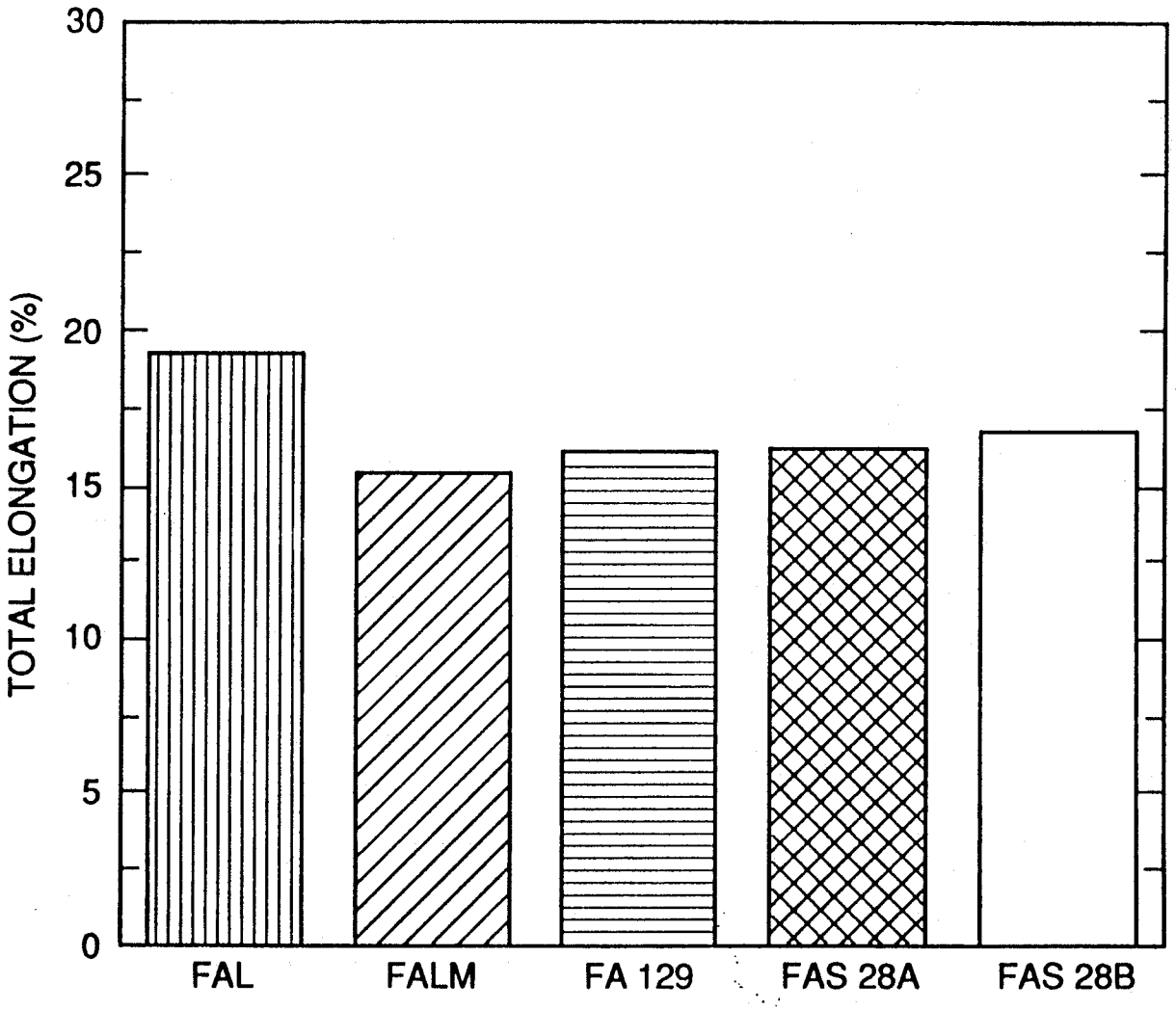
FIG. 5 is a bar graph showing the effect of composition and thermochemical procedure (TMP) on elongation of iron aluminide alloys in accordance with this invention. The TMP used was an anneal at 700° C. for 1 hr. followed by oil quenching.
Figure 6:
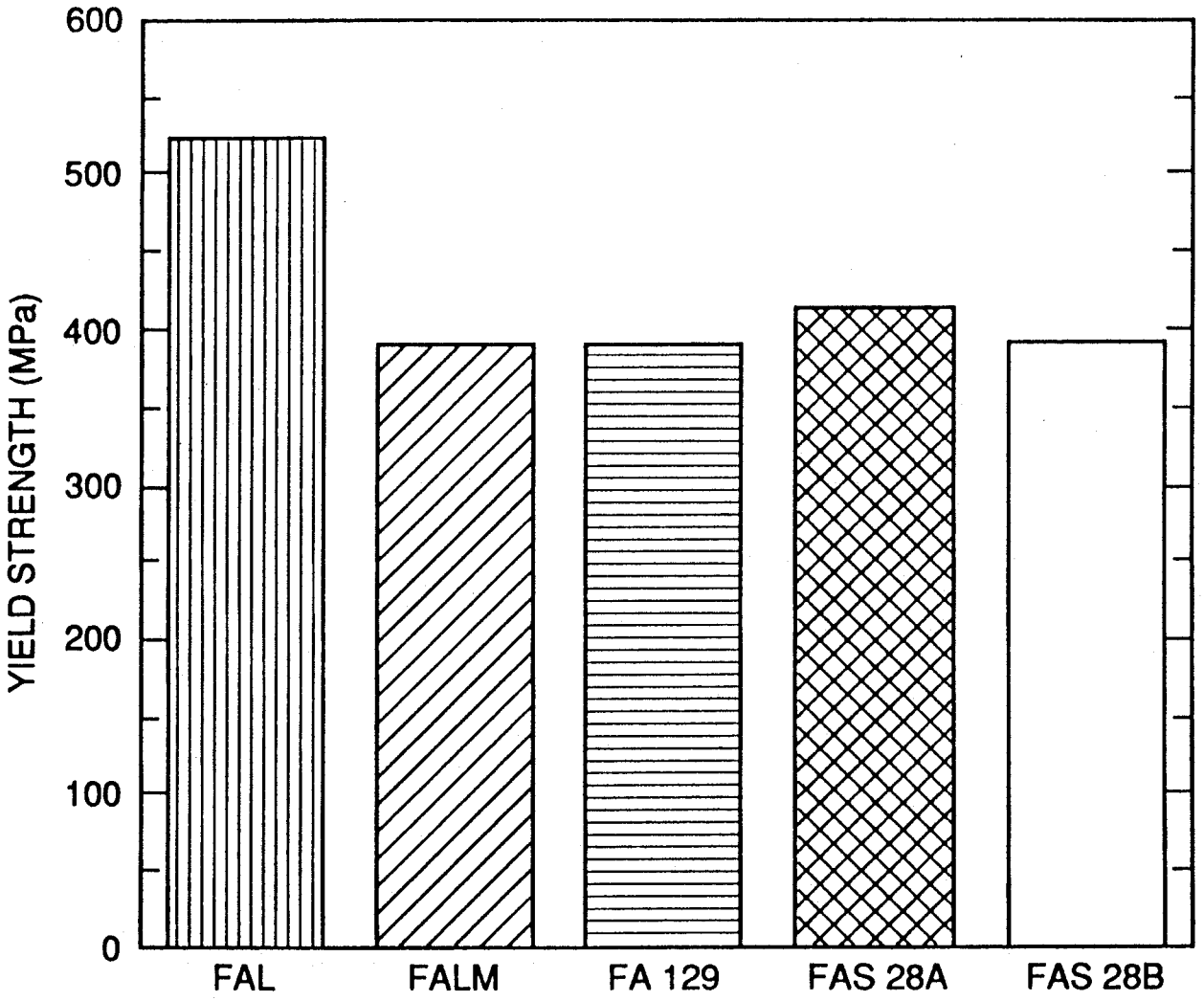
FIG. 6 is a bar graph showing the effect of composition and TMP on the yield strength of iron aluminide alloys in accordance with this invention. The TMP used was the same as described for FIG. 5.
Figure 7:
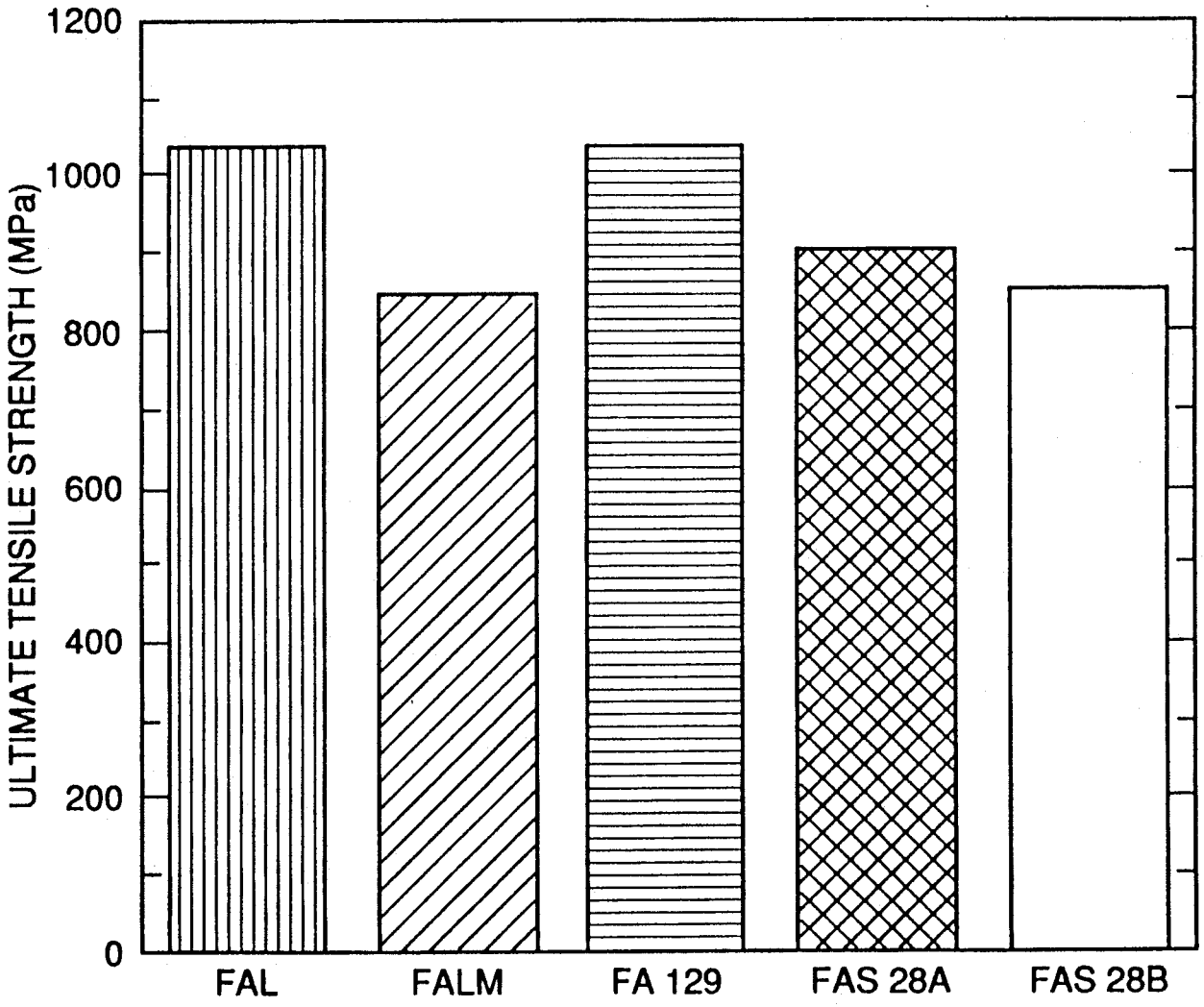
FIG. 7 is a bar graph showing the effect of composition and TMP on the ultimate tensile strength (UTS) of iron aluminide alloys in accordance with this invention. The TMP used was the same as described for FIG. 5.

The 700° C. heat treatment followed by oil quenching was applied to several alloy compositions shown in Table I. The results of this study are shown in FIGS. 5 through 7. FIG. 5 shows that a 700° C. treatment followed by oil quenching produced room temperature ductility values of over 15% for all alloys. The highest value was observed for the FAL alloy, also shown in FIG. 1. The yield and tensile strength values are highest for the alloys with the highest ductility, FIGS. 6 and 7. These figures show that 700° C. treatment followed by oil quenching can produce tensile elongation values of over 15% for alloys of significantly varying compositions.

Figure 8:
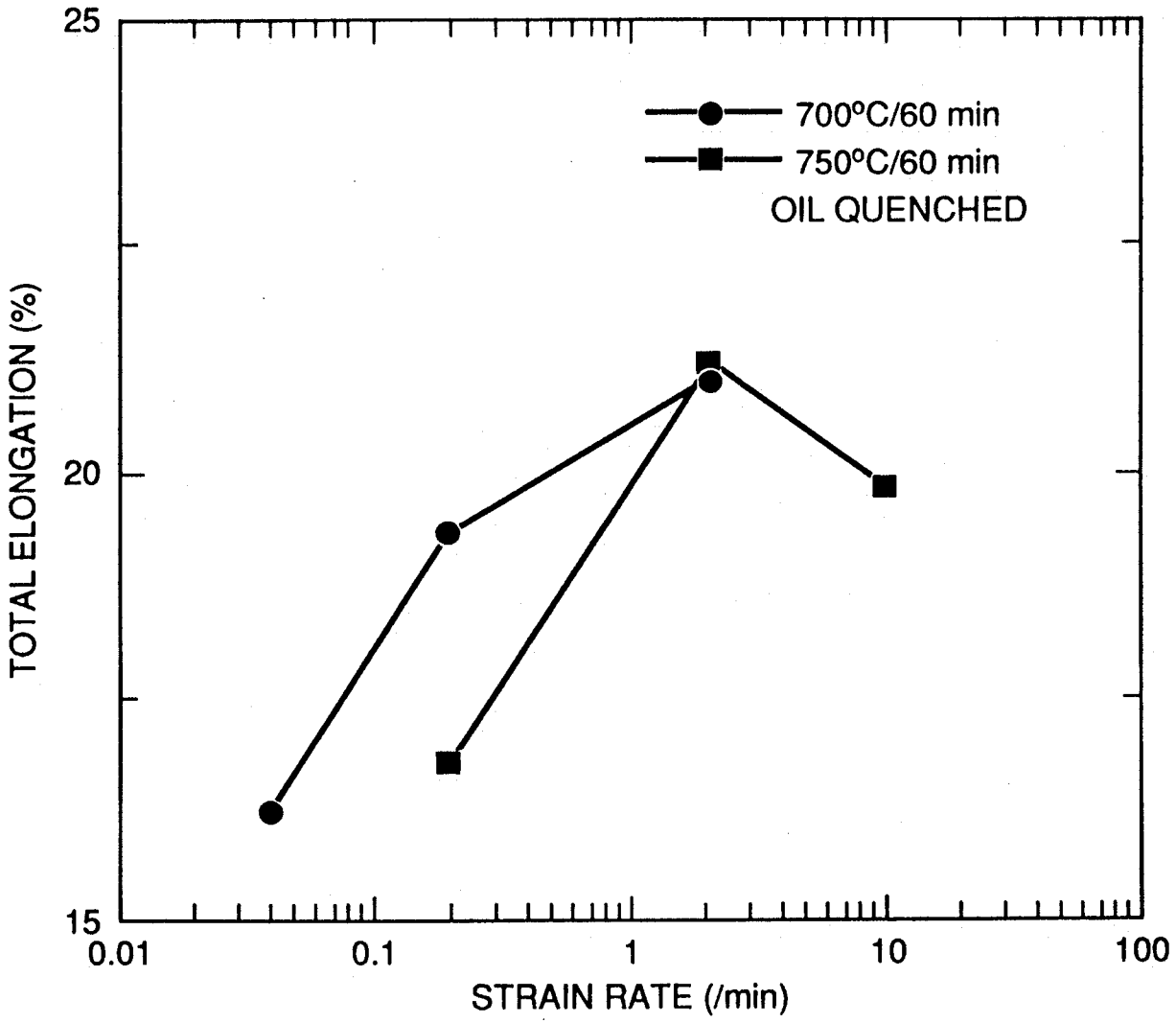
FIG. 8 is a graph showing the effect of strain rate on the room temperature elongation of iron aluminide alloy.

The tensile elongation values at room temperature for the alloy FAL are plotted as a function of strain rate in FIG. 8. Note that ductility increases with increasing strain rate for annealing temperatures of 700° and 750° C. The highest elongation value of 22% was observed for a strain rate of 2 in./in./min. The strain rate effect indicates that test environment may have some affect on room temperature elongation.

As a further demonstration of this invention, a series of alloys were prepared and tested as described in Example I.

EXAMPLE I

A group of test alloy samples were prepared by arc melting and then drop casting pure elements in selected proportions which provided the desired alloy compositions. this included the preparation of the binary Fe-28 at. % Al alloy for comparison. The alloy ingots were homogenized at 1000 degrees C and fabricated into sheets by hot rolling, beginning at 1000 degrees C and ending at 650 degrees C, followed by final warm rolling at 600 degrees C to produce a cold-worked structure. The rolled sheets were typically 0.76 mm thick.

Table II lists specifics of the test alloys giving their alloy identification number. The total amount of the additives to the Fe-28Al base composition (FA-61) range from about 2 to about 14 atomic percent. The alloy compositions were selected from the alloys described in copending, commonly assigned application Ser. No. 319,771, filed Mar. 7, 1989, and incorporated herein by reference. Specimens from each alloy were given either a heat treatment "A" or heat treatment "B". Heat treatment "A" is the conventional heat treatment and consists of one hour at 850° C. followed by 1–7 days at 500° C. in air followed by cooling in air. Heat treatment "B", in accordance with the present invention, consists of heating for one hour at 750° C. in air, followed by an oil quench.

Table II compares the effect of the present heat treatment and oil quenching (heat treatment B) with the results obtained using the conventional heat treatment (heat treatment A). Note that in almost every instance, the yield strength, ultimate tensile strength, and tensile elongation is improved when the subject heat treatment and oil quench is used on the various iron aluminide compositions. Note that alloys FA-61 and FA-91 contain no chromium but showed significant improvement after treatment as described herein.

Figure 9:
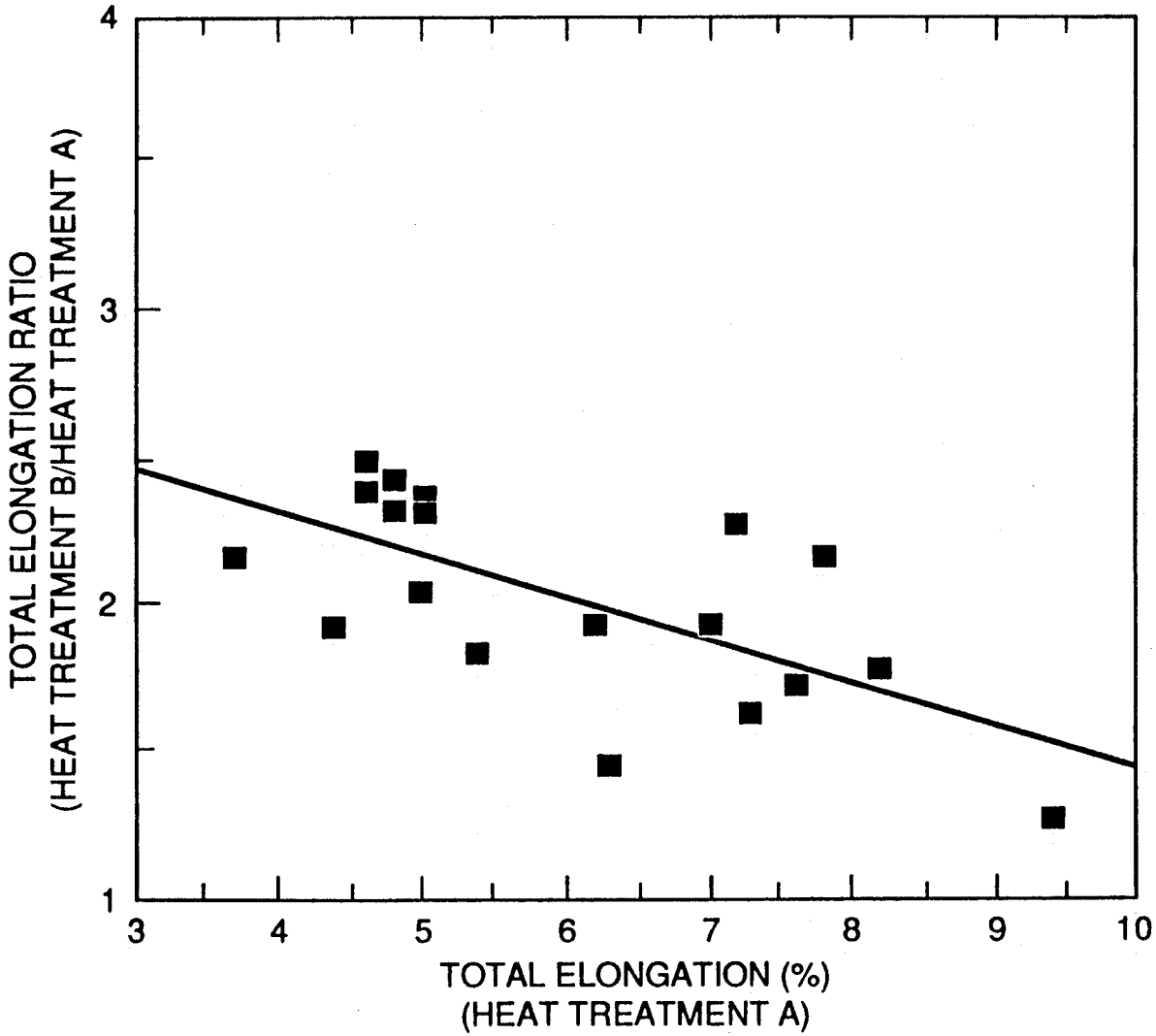
FIG. 9 is a graph showing a comparison of the room temperature elongation of 19 alloys given a heat treatment in accordance with the present invention and the conventional heat treatment used in the prior art.

To further demonstrate the improvement to be obtained by practice of the present invention, the ratio of total elongation for both heat treatments B and A was plotted as a function of total elongation for heat treatment A for 19 different compositions of $Fe_3Al$-based iron aluminides as shown in FIG. 9. This figure shows that heat treatment B nearly doubled the total elongation of all the compositions tested.

EXAMPLE II

To further demonstrate the invention, two batches of powder with stoichiometries designed to yield $Fe_3Al$ and containing nominally 2% and 5% chromium were produced using an inert gas atomizer with argon. These powders were obtained from the Idaho National Engineering Laboratory, Idaho Falls, Id. The powders were extruded in mild steel cans at 1000° C. to an area reduction ratio of 9:1. After removing the steel can, bar was hot forged at 1000° C. to a diameter of 0.34 inches followed by hot rolling at 800° C. to a thickness of 0.100 in. The alloy was then hot rolled at 650° C. to a thickness of 0.30 in. The sheet, thus formed, was stress relieved and punched into tensile specimens. The tensile specimens were annealed at 700° C., 750° C., 800° C. and 850° C. The results are shown in Table III for alloys containing 2% Cr and in Table IV for alloys containing 5% Cr. Note that the oil quenched specimens show consistently higher ductilities than do the air cooled specimens. Note also that the specimens annealed at 800° C. and below also consistently show better ductilities than do the specimens annealed at temperatures above 800° C.

As demonstrated previously by McKamey and Liu (Ser. No. 319,771), composition has an effect on ductility in iron aluminide intermetallic alloys. The applicant in the subject case has determined that there is also a strong heat treatment effect on ductility. The heat treatment effect can be further broken into two components, 1) the annealing temperature, and 2) the cooling medium. As has been demonstrated herein, regardless of the compositional effect, the use of the present heat treatment and oil quench always provides a further improvement in ductility.

The preceding examples are set forth to demonstrate the improvements to be enjoyed when practicing the present invention. This description is not intended to limit the scope of the invention since there are undoubtedly additional embodiments within the scope of the claimed invention which will be apparent to one of ordinary skill in the art.

TABLE II

EFFECT OF HEAT TREATMENT ON MECHANICAL PROPERTIES OF IRON ALUMINIDES

| | | Heat treatment A | | | Heat treatment B | | |
|---|---|---|---|---|---|---|---|
| | Composition | Yield | Ultimate | Elong. | Yield | Ultimate | Elong. |
| Alloy | (at.) | (ksi) | (ksi) | (%) | (ksi) | (ksi) | (%) |
| FA-61 | Fe—28Al | 40.5 | 74.6 | 3.7 | 63.0 | 103.8 | 8.0 |
| FA-72 | Fe—28Al—4Cr | 33.1 | 80.3 | 8.2 | 55.4 | 109.0 | 14.6 |
| FA-77 | Fe—28Al—2Cr | 35.8 | 92.6 | 9.4 | 58.4 | 110.6 | 12.1 |
| FA-91 | Fe—28Al—2Mo—.1Zr | 58.8 | 69.6 | 1.9 | 101.2 | 134.6 | 5.7 |
| FA-109 | Fe—27Al—4Cr—.8Nb—.05B—.1Mo | 39.5 | 99.7 | 9.4 | 73.6 | 112.4 | 7.5 |
| FA-110 | Fe—27Al—4Cr—.8Nb—.05B—.3Mo | 47.6 | 95.4 | 7.3 | 68.6 | 123.4 | 12.0 |
| FA-111 | Fe—27A1—4Cr—.8Nb—.05B—.5Mo | 48.6 | 93.5 | 6.3 | 72.4 | 117.8 | 9.2 |
| FA-122 | Fe—28Al—5Cr—.1Zr—.05B | 45.2 | 79.2 | 7.2 | 69.7 | 141.1 | 16.4 |
| FA-123 | Fe—28Al—5Cr—.5Nb—.5Mo—.1Zr—.05B—.02Y | 52.7 | 80.3 | 4.6 | 86.2 | 143.3 | 11.5 |
| FA-124 | Fe—28Al—5Cr—.05B | 37.2 | 81.8 | 7.6 | 53.2 | 105.4 | 13.2 |
| FA-127 | Fe—28A—5Cr—.5Nb | 42.3 | 72.4 | 5.0 | 60.2 | 116.3 | 11.6 |
| FA-128 | Fe—28Al—5Cr—.5Nb—.05B | 43.9 | 86.9 | 7.0 | 62.7 | 126.8 | 13.6 |
| FA-129 | Fe—28Al—5Cr—.5Nb—.2C | 46.4 | 98.5 | 7.8 | 55.7 | 134.9 | 16.9 |
| FA-131 | Fe—28Al—5Cr—.5Nb—.5Mo—.05B | 46.4 | 79.2 | 4.6 | 65.4 | 118.4 | 11.0 |
| FA-133 | Fe—28Al—5Cr—.5Nb—.5Mo—.1Zr—.2B | 55.0 | 91.4 | 5.0 | 85.4 | 139.9 | 10.2 |
| FA-135 | Fe—28Al—2Cr—.5Nb—.05B | 44.8 | 86.3 | 6.2 | 51.2 | 122.5 | 12.0 |
| FA-136 | Fe—28Al—2Cr—.5Nb—.2C | 43.7 | 82.2 | 5.0 | 50.4 | 118.3 | 11.8 |
| FA-137 | Fe—27Al—4Cr—.8Nb—.1Mo—.05B—.1Y | 56.6 | 92.9 | 4.8 | 74.7 | 131.9 | 11.2 |
| FA-141 | Fe—28Al—5Cr—.5Nb—.05B—.2V | 43.6 | 74.4 | 4.8 | 55.2 | 110.3 | 11.6 |
| FA-142 | Fe—28Al—5Cr—.5Nb—.05B—.5V | 41.0 | 76.8 | 5.4 | 57.1 | 108.3 | 9.9 |
| FA-143 | Fe—28Al—5Cr—.5Nb—.05B—1V | 42.4 | 69.2 | 4.4 | 58.8 | 102.2 | 8.5 |

Heat treatment A = 1 h at 850° C. plus 5-7 d at 500° C. (air), air cool.
Heat treatment B = 1 h at 750° C. (air), oil quench.

TABLE III

Tensile properties of $Fe_3Al$ + 2% Cr alloy

| | Heat treatment | | | | | | | | | | | |
|---|---|---|---|---|---|---|---|---|---|---|---|---|
| | Sheet treatment | | | Specimen treatment | | | | | Strength (ksi) | | Ductility (%) | |
| Specimen number | T (°C.) | Time (h) | Cooling medium | T (°C.) | Time (h) | Cooling medium | Test temperature (°C.) | Strain rate min-1 | 0.2% Yield | Tensile strength | Elongation | Reduction of area |
| 1L | 700 | 1 | OQ[a] | 700 | 1 | OQ[a] | 25 | 0.2 | 58.43 | 123.99 | 14.00 | 9.77 |
| 2L | 700 | 1 | OQ[a] | 700 | 1 | OQ[a] | 25 | 0.2 | 61.15 | 118.15 | 11.54 | 8.09 |
| 3L | 700 | 1 | OQ[a] | 700 | 1 | AC[b] | 25 | 0.2 | 62.60 | 129.19 | 11.80 | 6.91 |
| 4L | 700 | 1 | OQ[a] | 700 | 1 | AC[b] | 25 | 0.2 | 62.45 | 118.12 | 9.94 | 7.63 |
| 5L | 700 | 1 | OQ[a] | 750 | 1 | OQ[a] | 25 | 0.2 | 62.42 | 132.21 | 15.86 | 10.95 |
| 6L | 700 | 1 | OQ[a] | 750 | 1 | AC[b] | 25 | 0.2 | 60.45 | 122.84 | 12.40 | 7.19 |
| 7L | 700 | 1 | OQ[a] | 800 | 1 | OQ[a] | 25 | 0.2 | 64.46 | 132.33 | 15.66 | 10.68 |
| 8L | 700 | 1 | OQ[a] | 800 | 1 | AC[b] | 25 | 0.2 | 65.91 | 130.75 | 12.20 | 8.24 |
| 9L | 700 | 1 | OQ[a] | 850 | 1 | OQ[a] | 25 | 0.2 | 63.93 | 118.10 | 11.32 | 8.48 |
| 10L | 700 | 1 | OQ[a] | 850 | 1 | AC[b] | 25 | 0.2 | 68.69 | 128.73 | 11.18 | 8.18 |
| 11L | 700 | 1 | OQ | 750 | 1 | OQ | 100 | 0.2 | 56.09 | 127.49 | 18.94 | 12.62 |
| 12L | 700 | 1 | OQ | 750 | 1 | OQ | 300 | 0.2 | 49.17 | 131.30 | 33.86 | 20.27 |
| 13L | 700 | 1 | OQ | 750 | 1 | OQ | 500 | 0.2 | 45.55 | 79.84 | 35.34 | 25.78 |
| 14L | 700 | 1 | OQ | 750 | 1 | OQ | 700 | 0.2 | 20.43 | 21.50 | 73.34 | 47.94 |
| 15L | 700 | 1 | OQ | 750 | 1 | OQ | 800 | 0.2 | 2.63 | 2.76 | 89.74 | 56.32 |

[a]OQ = Oil quench
[b]AC = Air cool.

TABLE IV

Tensile properties of $Fe_3Al$ + 5% Cr alloy

| Specimen number | Heat treatment: Sheet treatment T (°C.) | Time (h) | Cooling medium | Specimen treatment T (°C.) | Time (h) | Cooling medium | Test temperature (°C.) | Strain rate min-1 | Strength (ksi): 0.2% Yield | Tensile strength | Ductility (%): Elongation | Reduction of area |
|---|---|---|---|---|---|---|---|---|---|---|---|---|
| 1L | 700 | 1 | OQ[a] | 700 | 1 | OQ[a] | 25 | 0.2 | 59.13 | 125.13 | 15.20 | 10.58 |
| 2L | 700 | 1 | OQ[a] | 700 | 1 | OQ[a] | 25 | 0.2 | 57.81 | 127.07 | 16.16 | 9.59 |
| 3L | 700 | 1 | OQ[a] | 700 | 1 | AC[b] | 25 | 0.2 | 56.86 | 109.60 | 10.74 | 8.93 |
| 4L | 700 | 1 | OQ[a] | 700 | 1 | AC[b] | 25 | 0.2 | 57.91 | 111.95 | 12.10 | 8.88 |
| 5L | 700 | 1 | OQ[a] | 750 | 1 | OQ[a] | 25 | 0.2 | 57.31 | 120.49 | 14.86 | 7.83 |
| 6L | 700 | 1 | OQ[a] | 750 | 1 | AC[b] | 25 | 0.2 | 52.76 | 101.95 | 10.70 | 8.06 |
| 7L | 700 | 1 | OQ[a] | 800 | 1 | OQ[a] | 25 | 0.2 | 55.53 | 113.83 | 13.94 | 8.80 |
| 8L | 700 | 1 | OQ[a] | 800 | 1 | AC[b] | 25 | 0.2 | 54.46 | 115.62 | 13.92 | 9.98 |
| 9L | 700 | 1 | OQ[a] | 850 | 1 | OQ[a] | 25 | 0.2 | 57.08 | 115.81 | 14.04 | 10.02 |
| 10L | 700 | 1 | OQ[a] | 850 | 1 | AC[b] | 25 | 0.2 | 56.19 | 108.20 | 11.12 | 8.74 |
| 11L | 700 | 1 | OQ | 750 | 1 | OQ | 25 | 0.2 | 58.90 | 137.43 | 18.5 | 11.10 |
| 12L | 700 | 1 | OQ | 750 | 1 | OQ | 25 | 0.2 | 59.41 | 134.66 | 17.8 | 11.45 |
| 13L | 700 | 1 | OQ | 750 | 1 | OQ | 25 | 0.2 | 59.25 | 134.01 | 18.40 | 11.01 |
| 14L | 700 | 1 | OQ | 750 | 1 | OQ | 25 | 0.2 | 58.48 | 135.41 | 18.20 | 11.15 |
| 15L | 700 | 1 | OQ | 750 | 1 | OQ | 25 | 0.2 | 59.40 | 140.76 | 21.04 | 11.71 |
| 16L | 700 | 1 | OQ | 750 | 1 | OQ | 100 | 0.2 | 52.72 | 122.92 | 17.66 | 12.64 |

[a]OQ = Oil quench.
[b]AC = Air cool.

I claim:

1. A method for improving the room temperature ductility and high temperature strength of iron aluminide intermetallic alloys comprising:
   a) thermomechanically working said alloys by means which produce an elongated grain structure, the elongated grains making up said elongated grain structure being oriented generally in the primary working direction;
   b) heating said alloys at a temperature and for a period of time sufficient to produce a B2-type crystal structure; and
   c) rapidly cooling said alloys in a moisture free medium, retaining said B2-type crystal structure to provide alloys having improved room temperature ductility and strength.

2. The method of claim 1 wherein said iron aluminide intermetallic alloy comprises an alloy based on the composition $Fe_3Al$.

3. The method of claim 2 wherein greater than 95% of said elongated grains in said elongated grain structure have an aspect ratio greater than about 20.

4. The method of claim 2 wherein said iron aluminide intermetallic alloy is heated at a temperature in the range of 650° C. to 800° C.

5. The method of claim 2 wherein said iron aluminide intermetallic alloy is held at said temperature for a period of time in the range of 15 minutes to 2 hours.

6. A method for improving the room temperature ductility and strength of an iron aluminide intermetallic alloy consisting essentially of 25 to 31 at. % aluminum, minor alloying constituents and iron comprising:
   a) thermomechanically working said alloy by means which produce an elongated grain structure, the elongated grains making up said elongated grain structure being oriented generally in the primary working direction and greater than 95% of said elongated grains having an aspect ratio greater than about 20;
   b) heating said alloys at a temperature and for a period of time sufficient to produce a B2-type crystal structure; and
   c) quenching said alloys in a moisture-free medium, retaining said B2-type crystal structure to provide alloys having improved room temperature ductility and strength.

7. The method of claim 6 wherein said alloy is heated in the temperature range of 650° C. to 800° C. for a period of time in the range of 15 minutes to 2 hours.

8. The method of claim 6 wherein said alloy is heated in the temperature range of 700° C. to 750° C. for a period of time in the range of 15 minutes to 2 hours.

9. A new method for improving the room temperature ductility and strength of an iron aluminide intermetallic alloy comprising:
   a) thermomechanically working an alloy consisting essentially of 25 to 31 at. % aluminum, up to a total of about 12 at. % of an element or combination of elements selected from the class consisting of Cr, Zr, Nb, Mo, B, C, and mixtures thereof, and the balance iron, by means which produce an elongated grain structure, the elongated grains making up said elongated grain structure being oriented generally in the primary working direction, greater than 95% of said elongated grains having an aspect ratio greater than about 20;
   b) heating said alloys at a temperature in the range of 650° C. to 800° C. for a period of time in the range of 15 minutes to 2 hours to produce a B2-type crystal structure; and
   c) quenching said alloys in oil to retain said B2-type crystal structure to provide alloys having improved room temperature ductility and strength.

10. The method of claim 9 wherein said thermomechanical working is achieved by any one of extrusion, drawing, rolling and mixtures thereof.

11. An improved ordered iron aluminide intermetallic alloy product having improved room temperature ductility and strength made by the process comprising:
   a) thermomechanically working said alloy by means which produce an elongated grain structure, the elongated grains in said elongated grain structure being oriented generally in the primary working direction and greater than 95% of said elongated grains having an aspect ratio greater than about 20;
   b) heating said alloys at a temperature and for a period of time sufficient to produce a B2-type crystal structure; and
   c) rapidly cooling said alloys in a moisture-free medium, retaining said B2-type crystal structure to provide alloys having improved room temperature ductility and strength.

* * * * *